US005516293A

United States Patent [19]

Heidel et al.

[11] Patent Number: 5,516,293

[45] Date of Patent: May 14, 1996

[54] GAMING MACHINE COIN HOPPER COIN SENSOR

[75] Inventors: Raymond Heidel, Henderson; Albert J. Hanis, Las Vegas; Thomas N. Taxon, Henderson, all of Nev.

[73] Assignee: Bally Gaming International, Inc., Las Vegas, Nev.

[21] Appl. No.: 224,364

[22] Filed: Apr. 7, 1994

[51] Int. Cl.[6] ..... G07D 9/04

[52] U.S. Cl. ..... 453/32; 250/214 B

[58] Field of Search ..... 453/32; 377/7; 250/214 B

[56] References Cited

U.S. PATENT DOCUMENTS

| | | | |
|---|---|---|---|
| 1,389,634 | 9/1921 | Donnellan . | |
| 1,776,251 | 9/1930 | Donnellan . | |
| 2,423,502 | 7/1947 | Jorgensen . | |
| 2,635,730 | 4/1953 | Seckula . | |
| 3,045,864 | 7/1962 | Hurst et al. | 221/7 |
| 3,173,431 | 3/1965 | Chichester et al. . | |
| 3,187,760 | 6/1965 | Simjian . | |
| 3,273,571 | 9/1966 | Seiden . | |
| 3,361,141 | 1/1968 | Weisskopf . | |
| 3,612,073 | 10/1971 | Carlos . | |
| 3,680,566 | 8/1972 | Tanaka et al. | 453/32 |
| 3,698,537 | 10/1972 | Black et al. | 198/33 |
| 3,942,544 | 3/1976 | Breitenstein et al. . | |
| 4,036,242 | 7/1977 | Breitenstein et al. . | |
| 4,148,331 | 4/1979 | Nicolaus . | |
| 4,437,478 | 3/1984 | Abe . | |
| 4,441,515 | 4/1984 | Goepner . | |
| 4,475,564 | 10/1984 | Koester et al. . | |
| 4,476,884 | 10/1984 | Gonzalez . | |
| 4,490,607 | 12/1984 | Pease et al. | 250/227 |
| 4,518,001 | 5/1985 | Branham . | |
| 4,518,098 | 5/1985 | Fleischer | 221/15 |
| 4,519,077 | 5/1985 | Amin | 371/21 |
| 4,541,444 | 9/1985 | Okada . | |
| 4,565,275 | 1/1986 | Hagiwara . | |
| 4,589,433 | 5/1986 | Abe . | |
| 4,822,318 | 4/1989 | Okada | 453/57 |
| 4,881,919 | 11/1989 | Dabrowski | 453/57 |
| 4,902,263 | 2/1990 | Ito et al. | 453/49 |
| 4,978,322 | 12/1990 | Paulsen | 453/57 |
| 5,151,591 | 9/1992 | Johnson et al. | 250/214 B |
| 5,286,967 | 2/1994 | Bates | 250/214 B X |
| 5,336,882 | 8/1994 | Fooks et al. | 250/214 B X |

*Primary Examiner*—F. J. Bartuska
*Attorney, Agent, or Firm*—Jenner & Block

[57] ABSTRACT

A coin hopper having an optical-electrical coin sensor with a light source and a light detector is provided. The coin hopper includes a coin transport disc, a coin trough, and a coin payout chute. The coin sensor is secured to the hopper and is proximally located to the coin payout chute. The sensor is configured such that the light detector is substantially adjacent the coin transport disc and the light source is spaced apart from the coin transport disc. The sensor is operatively connected to the coin hopper control circuitry which shuts down the hopper after the appropriate number of coins is dispensed. The hopper may also include circuitry which, in conjunction with the light source, provides a pulsed or intermittent beam of light.

17 Claims, 2 Drawing Sheets

GAMING MACHINE COIN HOPPER COIN SENSOR

FIELD OF THE INVENTION

This invention relates to the field of gaming machine coin payout mechanisms and in particular to coin payout detectors.

BACKGROUND OF THE INVENTION

Gaming machines of the type used in casinos typically include coin or token payout mechanisms such as coin hoppers. In hopper-type mechanisms an inclined rotary coin disc or wheel is used to transport coins from a coin storage trough to a coin chute through which the coins are guided to a payout tray. Coin output of the hopper is normally controlled by a coin counter operatively connected to a coin sensing mechanism. For example, U.S. Pat. No. 3,942,544 discloses a mechanical coin sensing mechanism in which a coin, located close to the coin payout chute, deflects a knife which in turn engages a counter. Once the pre-set number of coins have been counted, the coin transport mechanism is automatically shut-down and payout ceases. As an alternative to such mechanical or roller activated switch mechanisms, some coin payout detectors use an optical-electrical switch located at the upper portion of the coin disc. The optical-electrical switch is secured to the hopper by a U-shaped mounting bracket such that the diode light source is adjacent to the coin disc and the light detector is positioned on the other side of the coins on the disc. As the coin passes between the light source and the detector, the light is momentarily blocked by the coin. The detector senses the lack of light and augments the total count of coins paid out. As with mechanical sensors and counters, payout ceases when the number of coins detected equals a predetermined number of coins.

It has been found that under some circumstances the coin detector mechanisms described above do not always provide an accurate count of the coins dispensed by the hopper mechanism. An inaccurate coin count in turn leads to inaccurate payouts in which too few or too many coins are paid out. A need therefore exists for a coin sensing mechanism which can be readily used with various sizes of coins and which accurately senses and counts the number of coins paid out by the gaming machine.

SUMMARY OF THE INVENTION

It is therefore an object of this invention to provide a coin hopper having a coin payout detector which provides an accurate count of the coins dispensed by a coin hopper.

Another object of this invention is to provide a coin hopper having a coin payout detector which generates an error signal when the detector generates a signal due to spurious stimuli not associated with the presence of a coin in the detector.

In keeping with these objects, a coin hopper having an optical-electrical coin sensor with a light source and a light detector is provided. The coin hopper includes a coin transport disc, a coin trough, and a coin payout chute. The coin sensor is secured to the hopper and is proximally located to the coin payout chute. The sensor is configured such that the light detector is substantially adjacent the coin transport disc and the light source is spaced apart from the coin transport disc. Because of this configuration, the detector is shielded from any spurious light when a coin is present in the detector. The sensor is operatively connected to the coin hopper control circuitry which shuts down the hopper after the appropriate number of coins is dispensed. The hopper may also include circuitry which, in conjunction with the light source, provides a pulsed or intermittent beam of light. The intermittent beam facilitates detecting the presence of a coin in the coin sensor. The intermittent beam also makes it possible for the coin hopper circuitry to distinguish between light originating from the light source and spurious light originating from some other source.

DETAILED DESCRIPTION

Figure 1:
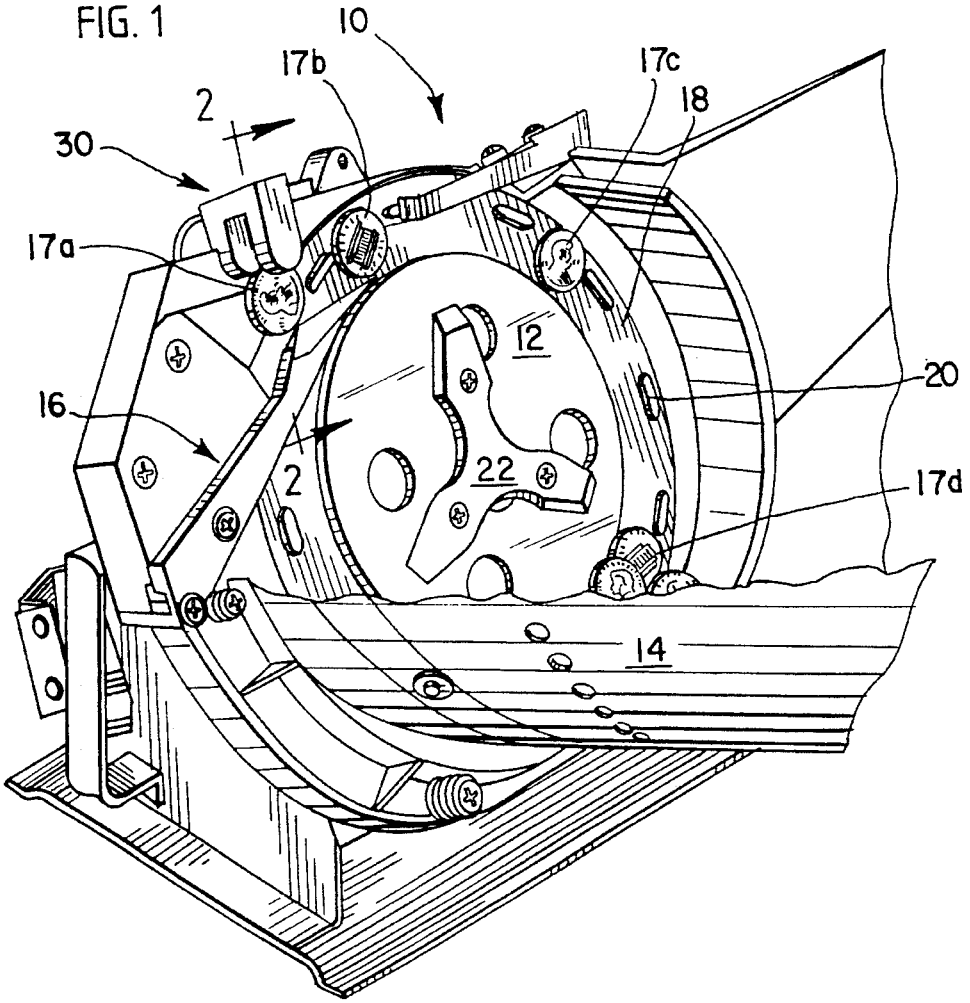
FIG. 1 is a perspective view of a coin hopper showing a coin detector according to the invention.

As shown in FIG. 1, a coin hopper 10 includes a coin transport disc 12, a coin tray or trough 14, and a coin payout chute 16. When payout is needed, coins 17*a–d* stored within tray 14 are transported by disc 12 to chute 16. Disc 12 is rotatably mounted in hopper 10 and includes a pin wheel 18 and a set of coin pins 20 affixed to pinwheel 18. When disc 12 rotates, the coins 17*b–d* caught between adjacent pins 20 are carried to chute 16 by pinwheel 18. A centrally mounted agitator 22 agitates the coins within tray 14 and prevents agglomerations of the coins. Transported coins 17*a–d* pass through a coin sensor 30 before being dispensed down coin chute 16. Sensor 30 is operatively connected to a coin counter (not shown) which counts the number of coins detected. When the number of coins detected equals a predetermined value, the counter sends a signal to the gaming machine control circuitry which stops the rotation of disc 12 and ceases the payout of coins.

Figure 2:
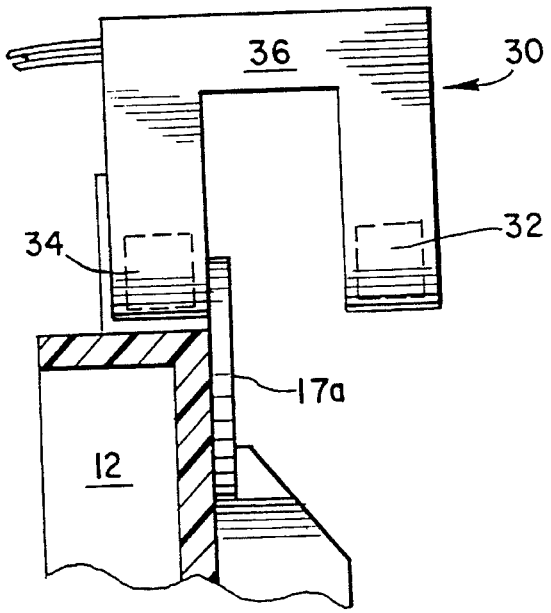
FIG. 2 is a side perspective view of the coin detector in FIG. 1.

FIG. 2 illustrates sensor 30 in more detail. Sensor 30 includes a light source 32 and a light detector 34 mounted to a U-shaped housing 36. Sensor 30 is mounted to hopper 10 by conventional methods, such as screws, and is positioned such that detector 34 is adjacent pinwheel 18 while light source 32 is spaced apart from pinwheel 18. Light source 32 can provide a steady light beam which is interrupted by a coin passing through sensor 30, such as coin 17A. Because the space between the coin 17*a* and detector 34 is small, the coin effectively shields detector 34 from spurious light which would cause a miscount of the dispensed coins.

Figure 3:
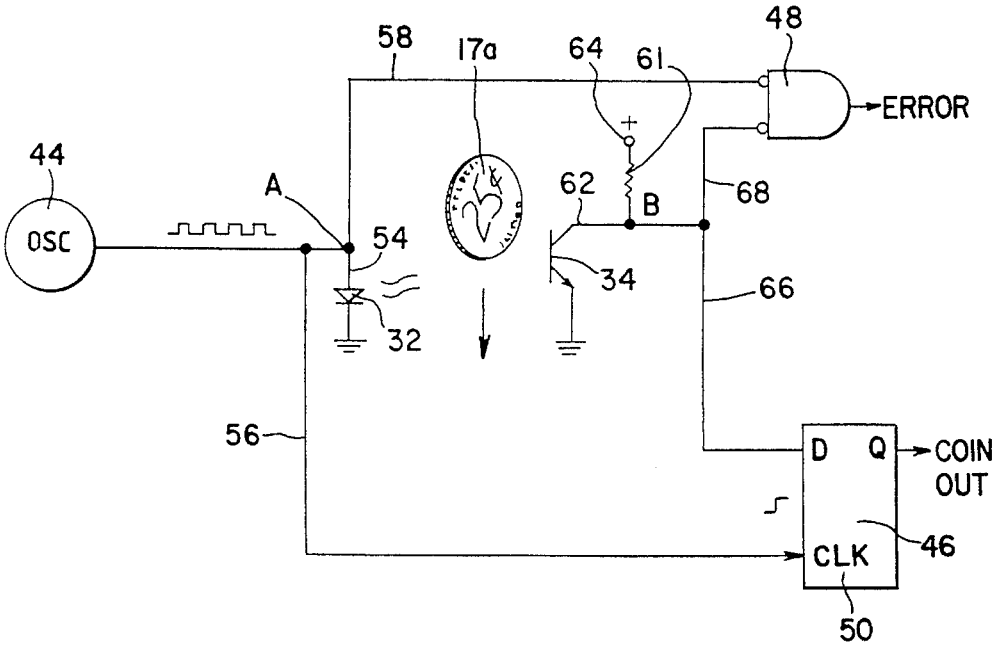
FIG. 3 is a schematic diagram of a circuit implementing a coin sensor having a pulsed light source.

The detecting ability of sensor 30 can be improved by using an interrupted or pulsed light source 32. FIG. 3 is a schematic diagram of a circuit implementing a optical-electrical coin sensor having light source 32 which in this case emits a pulsed beam. The circuit includes light source 32, detector 34 including a photo-sensitive transistor, a signal source 44, such as an oscillator, a flip flop 46, and an AND gate 48. Flip flop 46, which includes a clock 50 and a D input, provides a coin out signal as output Q when a coin, such as coin 17*a*, is present between light source 32 and detector 34. AND gate 48 provides an error signal when detector 34 is illuminated by spurious light not originating from light source 32.

Oscillator 44 provides a pulsed signal A to three circuit elements 32, 46, and 48. First, oscillator 44 sends pulsed signal A to light source 32 through a line 54. Pulsed signal A is also transmitted to clock input 50 of flip flop 46 by a line 56. Third, oscillator 44 transmits pulsed signal A to a first inverted input of AND gate 48 over a line 58.

Detector 34 is connected by a line 62 to a resistor 61 and a voltage source 64. Detector 34 and voltage source 64 together provide a signal B which is sent to two circuit elements: to input D of flip flop 46 by a line 66; and to a second inverted input of AND gate 48 over a line 68.

Figure 4:
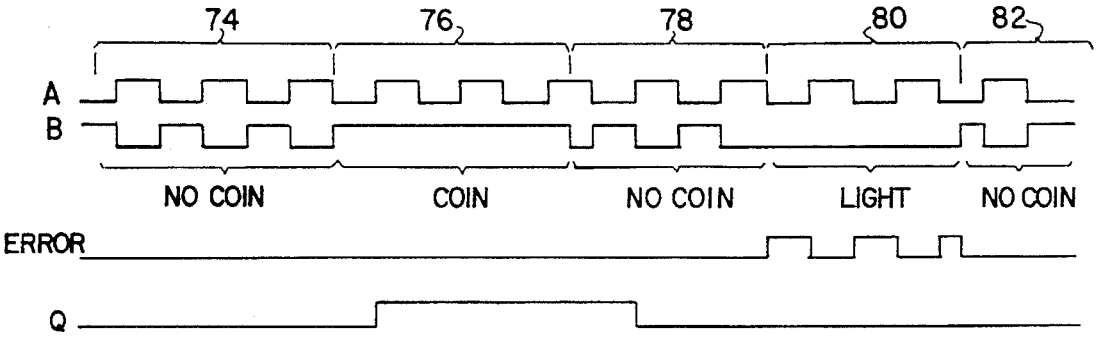
FIG. 4 is a timing diagram of the relevant signals generated by the circuit in FIG. 3.

FIG. 4 is a timing diagram illustrating the relationships among the various signals generated in the circuit of FIG. 3. Signal A represents the pulsed signal provided by oscillator 44 and by the light generated by light source 32. Signal B results from the switching into a conductive state of the transistor of detector 34, in combination with voltage source 64. The error signal is a logic 1 output signal of AND gate 48 and signal Q is the output signal of flip flop 46. The timing diagram is divided into 5 areas, 74–82. Areas 74, 78, and 82 represent the form of the signals when no coin is between light source 32 and detector 34. Area 76 represents the form of the signals when a coin, such as coin 17*a*, is present between light source 32 and detector 34, and area 80 represents the signals when no coin is present and detector 34 is illuminated by light not originating with light source 32.

Signal A is a pulsed signal in each of areas 74–82. The form of signal B varies, depending on whether there is any light illuminating detector 34. In area 74, where no coin and no spurious light is present, pulsed signal A generates a pulsed signal in detector 34 which, because of the positive bias of voltage source 64, results in a pulsed signal B which is out-of-phase with signal A. When the coin 17*a* passes between source 32 and detector 34, the transistor in detector 34 is in a non-conducting mode and, coupled with the positive bias of voltage source 64, results in a positive signal B, as shown in area 76. After the coin 17*a* moves out from between light source 32 and detector 34, signal B again corresponds to the signal A, as shown in area 78.

A continuous high signal B, as in area 76, thus indicates the presence of the coin 17*a* in the optical-electrical sensor 30. Because the coins are moving through sensor 30 and toward the coin payout chute 16, the frequency of pulsed signal A is preferably greater than the speed at which coins pass through sensor 30 thereby transmitting more than one light pulse per coin. Thus, for example, as shown in FIG. 4 the frequency of signal A is about 2–3 times faster than the speed of the coin 17*a*. Preferably, the frequency of pulsed signal A would typically be 100 or more times faster than the speed of the coin 17*a* to ensure accurate edge detection of the coins.

Area 80 illustrates the relationship between source signal A and detector signal B when detector 34 is illuminated by light not originating from light source 32. The combined effects of pulsed signal A, the spurious light, and voltage source 64 result in a continuous low signal B. When the light disappears, signal B again corresponds to signal A, as shown in area 82.

On the terminal Q is the output signal of coin counter or flip flop 46. Referring back to FIG. 3, coin counter 46 actually receives two signals: clock input 50 receives signal A and input D receives signal B. Coin out signal Q is therefore a function of both signals A and B. Signal B initiates the signal indicating that the coin 17*a* is present between light source 32 and detector 34. A continuous high signal B, as in area 76 of FIG. 4, latches flip flop 46 with output Q in a high state in response to the clock signal A on 50. A high signal on output terminal Q will therefore indicate the presence of the coin 17*a* in coin sensor 30. When the coin 17*a* moves from between source 32 and detector 34, signal B again corresponds to the inverse of signal A thereby causing terminal Q of flip flop 46 to go low in response to the clock signal on line 56.

Flip flop 46 is only latched by a continuous high signal B, such as that shown in area 76, and is not affected when signal B remains low because of spurious light, as in area 80. Consequently, spurious light does not affect the coin counter circuitry and signal Q remains low in area 80.

The error signal is represented by a high output signal of AND gate 48 and indicates that detector 34 is illuminated by light not originating from light source 32. AND gate 48 compares signals A and B after receiving them on inverting input terminals. The error signal is not generated when no coin and no spurious light is present because under these conditions both signals A and B are pulsed and they complement each other. Consequently, the error signal is low in areas 74, 78, and 82. The error signal is also low when the coin 17*a* is present between source 32 and detector 34. Under these conditions, signal B is high thereby effectively shutting off AND gate 48, as shown in area 76. Upon inversion of signals A and B, this leads to a flat error signal as shown in area 76. However, when detector 34 is illuminated by spurious light, signal B is stays low and a pulsed error signal corresponding to signal A is generated, as shown in area 80.

The circuit in FIG. 3 thus performs two functions. First, the circuit uses a pulsed source signal to detect the presence of a coin in sensor 30. Second, the circuit also determines whether detector 34 is illuminated by spurious light. The error signal generated by spurious light can then be used as input for other device parameters. For example, the error signal could be used to activate a "maintenance needed" indicator. Alternatively, the error signal could be used to shut off the coin hopper entirely.

The coin and error detecting ability of the circuit in FIG. 3 can be enhanced by varying the pulse frequency of signal A. Thus, for example, signal source 44 could be driven by a microprocessor which changes the frequency of signal A. The output signal could also be input to a microprocessor. By coupling both the signal source and the output signal to a microprocessor, both the coin counting function and the error detection could be done with computer software. The pulse excitation signal could also be further randomized by using software algorithms. For example, the frequency could be programmed to change each time a coin payout is desired, or even to change during the duration of a signal payout. A source of random pulses or a signal source having a very loose frequency tolerance can also be used for signal source 44. Changing the frequency of signal A facilitates detecting spurious pulsed light which can affect the accuracy of the coin payout.

What is claimed is:

1. A device for controlling the number of coins dispensed from a coin hopper, comprising:

storage means for Storing the coins within the hopper;

dispensing means for dispensing coins from the storage means;

an optical-electrical coin sensor secured to the hopper and proximally located to said dispensing means, said optical-electrical coin sensor including a light source for emitting light and a light detector for detecting light incident on said detector;

means for determining whether the detected light originated from the same source as the emitted light; and means for generating an error signal whenever said light detector is illuminated by spurious light.

2. The device of claim 1 further comprising an indicator which is activated by said error signal.

3. The device of claim 1 wherein said error signal acts to disable the coin hopper so that no additional coins may be dispensed so long as there is an error signal.

4. In combination with a device for dispensing coins of the type wherein a coin hopper controls the number of coins dispensed from a coin hopper, including storage means for storing the coins within the hopper, dispensing means for dispensing coins from the hopper, transporting means for transporting the coins from said storage means to said dispensing means, control means for controlling said transporting means, and an optical-electrical coin sensor operatively connected to said control means, secured to the hopper and proximally located to said dispensing means, said optical-electrical coin sensor including a light source for emitting light and a light detector for detecting light incident on said detector, the improvement which comprises:

means for determining whether the detected light originates from the same source as the emitted light; and means for generating an error signal whenever said light detector is illuminated by spurious light.

5. The device in claim 4 wherein said means for determining whether the detected light originates from the same source as the emitted light comprises a light source which emits a pulsed, intermittent beam of light.

6. The device in claim 5 wherein said light detector is substantially adjacent said transporting means and said light source is spaced apart from said transporting means.

7. The device of claim 4 wherein the device includes an indicator which is activated by said error signal.

8. The device of claim 7 wherein the activation of said indicator signals that maintenance of the device is needed.

9. The device of claim 4 wherein said error signal acts to disable the coin hopper so that no additional coins may be dispensed so long as there is an error signal.

10. The device of claim 4 wherein said error signal is transmitted to a remote location to alert security.

11. A device for controlling the number of coins dispensed from a coin hopper, comprising:

storage means for storing the coins within the hopper;

dispensing means for dispensing coins from the hopper;

transporting means for transporting the coins from said storage means to said dispensing means;

control means for controlling said transporting means;

an optical-electrical coin sensor operatively connected to said control means, secured to the hopper and proximally located to said dispensing means, said optical-electrical coin sensor including a light source for emitting light and a light detector for detecting light incident on said detector;

means for determining whether the detected light originates from the same source as the emitted light; and means for generating an error signal whenever said light detector is illuminated by spurious light.

12. The device in claim 11 wherein said light detector is substantially adjacent said transporting means and said light source is spaced apart from said transporting means.

13. The device of claim 11 wherein the activation of said indicator signals that maintenance of the device is needed.

14. The device of claim 11 wherein said means for determining whether the detected light originates from the same source as the emitted light comprises a light source which emits a pulsed, intermittent beam of light.

15. The device of claim 11 further comprising an indicator which is activated by said error signal.

16. The device of claim 11 wherein said error signal acts to disable the coin hopper so that no additional coins may be dispensed so long as there is an error signal.

17. The device of claim 11 wherein said error signal is transmitted to a remote location to alert security.

* * * * *